US006685157B1

(12) United States Patent
Kennedy et al.

(10) Patent No.: US 6,685,157 B1
(45) Date of Patent: Feb. 3, 2004

(54) ORNAMENTAL SUPPORT POLE FOR A LUMINAIRE OR THE LIKE

(75) Inventors: Daniel R. Kennedy, Omaha, NE (US); Thomas F. Sanderson, Omaha, NE (US)

(73) Assignee: Valmont Industries, Inc., Valley, NE (US)

( * ) Notice: Subject to any disclaimer, the term of this patent is extended or adjusted under 35 U.S.C. 154(b) by 31 days.

(21) Appl. No.: 10/091,150

(22) Filed: Mar. 5, 2002

(51) Int. Cl.[7] ..... B08B 7/00; E04B 1/00

(52) U.S. Cl. ..... 248/694; 134/38; 427/154; 52/745.17

(58) Field of Search ..... 248/146, 694; 52/169.13, 745.17; 72/208; 134/38; 427/154, 156, 309; 118/208, 108

(56) References Cited

U.S. PATENT DOCUMENTS

| | | | | | |
|---|---|---|---|---|---|
| D76,509 | S | | 10/1928 | Waggoner | |
| 3,892,651 | A | | 7/1975 | Salisbury et al. | |
| 4,007,075 | A | * | 2/1977 | McClain et al. | 156/62.2 |
| 4,095,555 | A | * | 6/1978 | Kmetz | 118/208 |
| 4,138,513 | A | | 2/1979 | Srock et al. | |
| 4,142,343 | A | * | 3/1979 | Trafton | 52/736.2 |
| 4,677,935 | A | | 7/1987 | Fusi et al. | |
| 4,824,715 | A | | 4/1989 | Jackson | |
| 4,836,858 | A | * | 6/1989 | Reinhart | 134/1 |
| 4,878,160 | A | * | 10/1989 | Reneau et al. | 362/269 |
| 4,961,258 | A | * | 10/1990 | Menzel | 52/745.17 |
| 5,005,245 | A | | 4/1991 | Dooley et al. | |
| 5,175,971 | A | * | 1/1993 | McCombs | 52/736.2 |
| 5,327,694 | A | | 7/1994 | Gamel et al. | |
| 5,481,846 | A | | 1/1996 | Macchietto | |
| 5,505,749 | A | * | 4/1996 | Kirschner et al. | 51/309 |
| 5,572,846 | A | * | 11/1996 | Sosa | 52/736.4 |
| 5,595,082 | A | * | 1/1997 | Gandara | 72/196 |
| 5,641,141 | A | * | 6/1997 | Goodwin | 248/218.4 |
| 5,667,744 | A | * | 9/1997 | Valle et al. | 264/225 |
| 5,709,589 | A | | 1/1998 | Boone | |
| 5,787,649 | A | * | 8/1998 | Popowych et al. | 52/40 |
| 5,806,758 | A | * | 9/1998 | Erwin et al. | 232/39 |
| 6,142,868 | A | | 11/2000 | Pfanstiehl | |
| 6,542,320 | B1 | * | 4/2003 | Binnix | 359/884 |

* cited by examiner

*Primary Examiner*—Anita King
(74) *Attorney, Agent, or Firm*—Thomte, Mazour & Niebergall; Dennis L. Thomte

(57) ABSTRACT

An ornamental support pole for a luminaire is disclosed wherein the support pole is fluted to define longitudinally extending and spaced-apart flutes having radiused surfaces therebetween. The flutes are painted or coated so as to exhibit a color different than that of the radiused surfaces therebetween. The method of creating the pole structure is also described.

6 Claims, 2 Drawing Sheets

ORNAMENTAL SUPPORT POLE FOR A LUMINAIRE OR THE LIKE

BACKGROUND OF THE INVENTION

1. Field of the Invention

This invention relates to an ornamental support pole for a luminaire or the like and more particularly to a non-tapered and fluted or a tapered and fluted support pole for a luminaire or the like wherein the flutes exhibit a color or finish which is different than the color or finish of the radiused surfaces therebetween.

2. Description of the Related Art

Support poles for luminaires or the like are normally comprised of a hollow metal pole formed from steel or aluminum. The base of the support pole is normally secured to a suitable foundation or directly embedded in the earth with the upper end of the pole supporting one or more luminaires or the like thereon. In many cases, the entire exterior surface of the pole, including the flutes and the radiused surfaces therebetween, are painted with a single color. In other cases, the pole is not painted at all. It has been found that a highly ornamental support pole is achieved when the flutes of the pole are painted or coated with a paint or coating which is colored or finished differently than the radiused surface therebetween.

SUMMARY OF THE INVENTION

An ornamental support pole for a luminaire or the like is described as well as the method of forming the same. In the first method of forming the pole, the pole, which is either tapered or non-tapered, is formed from a metal such as steel or aluminum. The pole is then sanded to remove the die marks therefrom if any are present. A plurality of spaced-apart, longitudinally extending flutes are formed in the pole which define radiused surfaces therebetween. The entire pole is then painted or coated with a liquid paint or coating. The painted pole is then subjected to a sanding operation wherein the paint or coating from the radiused surfaces between and around the flutes is removed and which leaves paint or coating in the flutes. In an optional step, the entire pole is then painted or coated with a transparent, clear translucent, or tinted coating. The end product is a highly ornamental pole wherein the flutes and radiused surfaces therebetween exhibit different colors or finish appearance.

It is therefore a principal object of the invention to provide an ornamental support pole for a luminaire or the like as well as the method of forming the same.

A further object of the invention is to provide an ornamental untapered and fluted or tapered and fluted support pole for a luminaire or the like wherein the flutes and the radiused surfaces therebetween exhibit different colors or finish appearance.

These and other objects will be apparent to those skilled in the art.

DESCRIPTION OF THE PREFERRED EMBODIMENT

The numeral 10 refers to a tapered and fluted support pole which has its base 11 conveniently supported upon a proper footing or the like. The pole may also extend downward and be directly embedded in the earth. The numeral 12 refers to a luminaire which is conventionally mounted on the upper end of the support pole 10. Although the support pole 10 is preferably of the tapered configuration, non-tapered cylindrical support poles could also be utilized with this invention.

Figure 1:
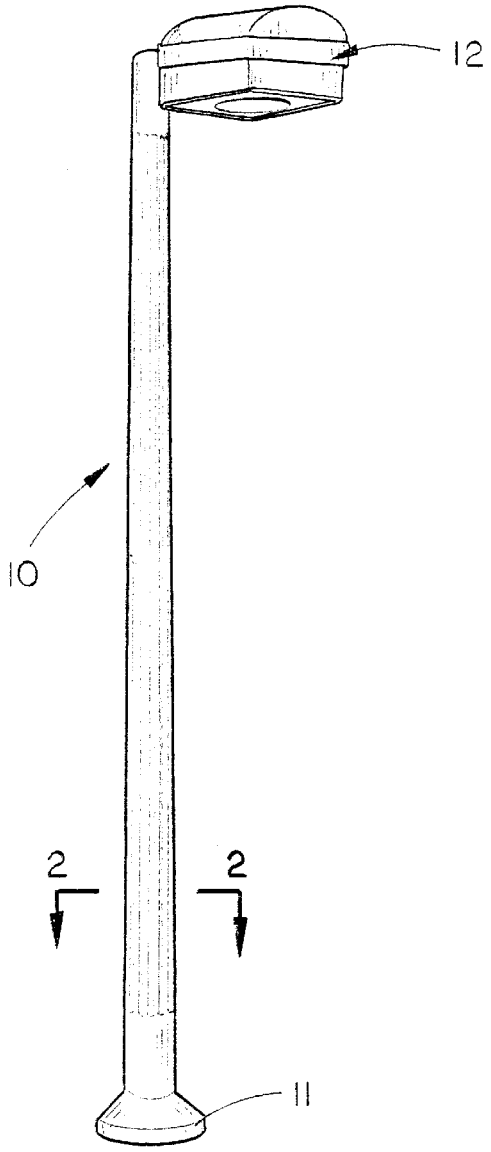
FIG. 1 is a perspective view of the pole of this invention.
Figure 2:
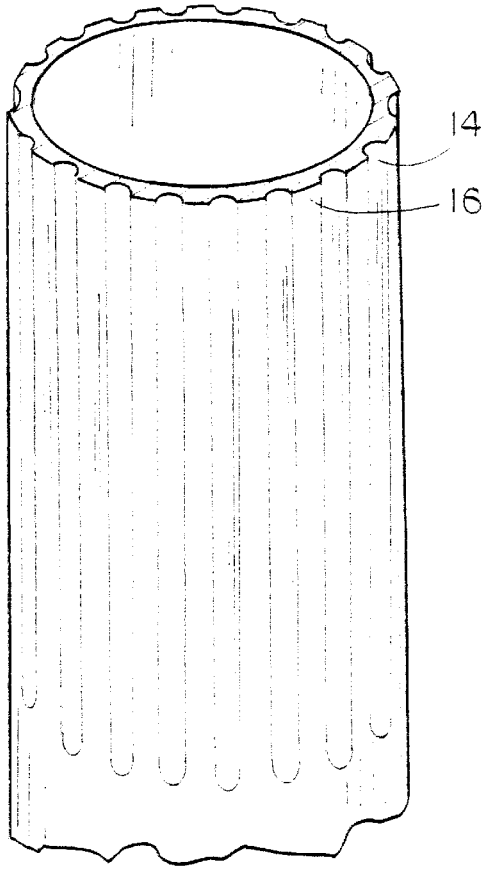
FIG. 2 is a sectional view of the pole as seen on lines 2—2 of FIG. 1.
Figure 3:
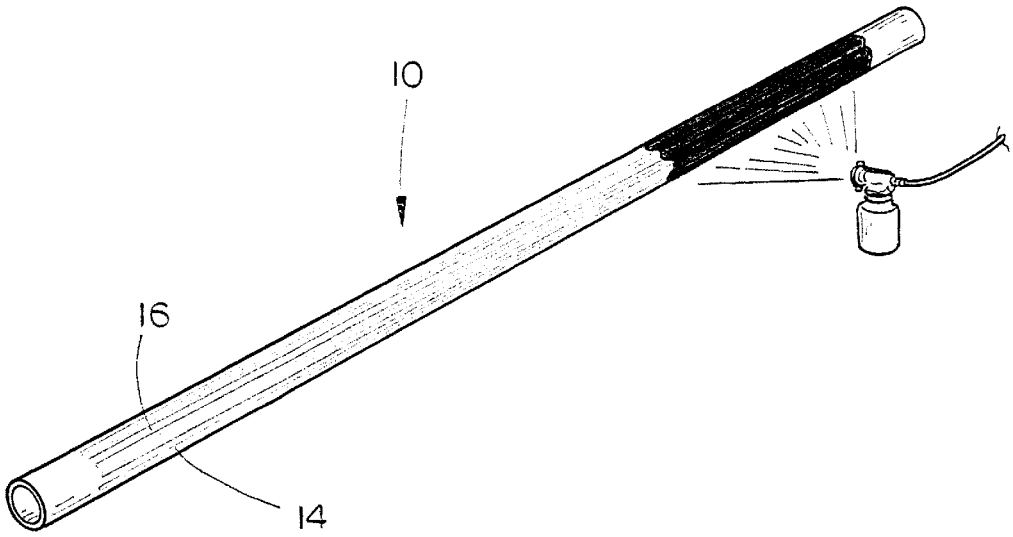
FIG. 3 is a perspective view illustrating the pole being painted.
Figure 4:
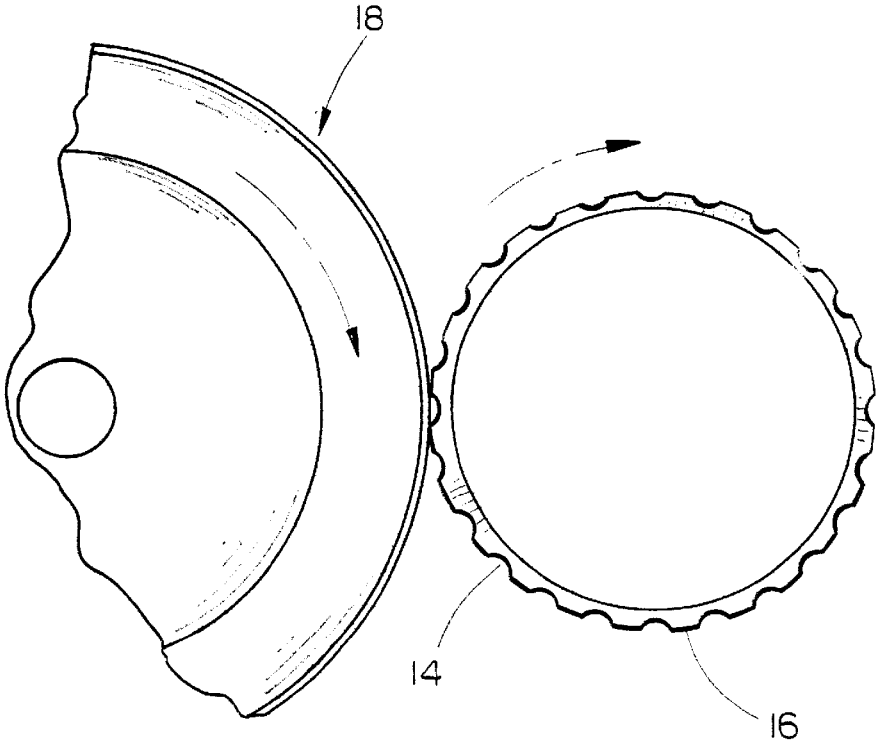
FIG. 4 is an end view illustrating the pole being sanded to remove the paint from the radius terminations.

The tapered and fluted support pole of this invention is formed as follows. The pole 10, either tapered or non-tapered, is formed from a metal such as steel or aluminum to define a hollow cylindrical cross-section, as seen in FIG. 2. If the pole has been tapered, there normally will be die marks present on the exterior surface of the pole. If die marks are present, the exterior surface of the pole is preferably sanded to remove those die marks. The next step in forming the pole is to create spaced-apart, longitudinally extending flutes 14 in the pole in a conventional fashion, thereby defining radiused surfaces 16 between the flutes 14. The precise shape of the radiused surfaces 16 may vary depending upon the particular style of fluting. Although FIGS. 2 and 4 illustrate that the interior surface of the pole 10 is cylindrical or smooth, the actual shape of the interior surface of the pole will usually mimic the outside fluted shape so as to provide a uniform wall thickness. The entire pole is then painted with a liquid paint or powder coated (FIG. 3). After the liquid paint or coating has been allowed to dry or is cured, the exterior surface of the pole is sanded with a conventional belt sander or cylindrical sander 18 to remove the paint or coating from the smooth radiused surfaces and which leaves paint or coating in the flutes 14 (FIG. 4). After the paint or coating has been sanded from the radiused surfaces, as described above, the entire pole, including radiused surfaces and flutes, may be painted or coated with a transparent, clear translucent, or tinted coating. The painting or coating of the entire pole tends to add color to the radiused surfaces. In other words, if a transparent or clear translucent paint or coating is applied over the flutes and the radiused surfaces, the radiused surfaces tend to take on or reflect some of the color from the flutes. The same is also true for a clear translucent or tinted coating.

Example A listed below sets forth the preferred steps of this invention while Example B sets forth a modified form of the method.

EXAMPLE A

Step 1. Form pole, either tapered or non-tapered, from metal such as steel or aluminum.

Step 2. Sand pole to remove die marks, if any.

Step 3. Create spaced-apart, longitudinally extending flutes in pole which define radiused surfaces therebetween.

Step 4. Paint or coat entire pole.*

Liquid paint, or liquid coating such as powder coating.

Step 5. Sand pole to remove paint or coating from radiused surfaces which leaves paint or coating in flutes.

Step 6. Paint or coat entire pole, radiused surfaces, and flutes with a transparent, clear translucent, or tinted coating.

EXAMPLE B

Step 1. Form pole, either tapered or non-tapered, from metal such as steel or aluminum.

Step 2. Create spaced-apart, longitudinally extending flutes in pole which define radiused surfaces therebetween.

Step 3. Paint or coat entire pole.*

Liquid paint, or liquid coating such as powder coating.

Step 4. Sand pole to remove paint or coating from radiused surfaces which leaves paint or coating in flutes.

It can therefore be seen that a highly ornamental support pole has been provided for a luminaire or the like.

Thus it can be seen that the invention accomplishes at least all of its stated objectives.

We claim:

1. The method of creating an elongated, hollow ornamental pole, comprising the steps of:

(a) forming a metal pole having an exterior surface;

(b) forming spaced-apart, longitudinally extending flutes in the pole which define radiused surfaces therebetween;

(c) painting or coating the exterior surface of the pole with a first liquid paint or powder coating having a particular color;

(d) sanding the pole to remove the first paint from a predetermined amount of each radiused surface therebetween thereby leaving the first paint or powder coating in the flutes.

2. The method of claim 1 wherein said metal pole is formed so as to be tapered.

3. The method of claim 2 further including the step of sanding the exterior surface of the pole to remove die marks thereon between steps (a) and (b).

4. The method of claim 1 wherein the entire exterior surface of the pole is painted or coated with a transparent coating after step (d).

5. The method of claim 1 wherein the entire exterior surface of the pole is painted or coated with a clear translucent coating after step (d).

6. The method of claim 1 wherein the entire exterior surface of the pole is painted or coated with a tinted coating after step (d).

* * * * *